US008801215B2

(12) United States Patent
Balfour

(10) Patent No.: US 8,801,215 B2
(45) Date of Patent: Aug. 12, 2014

(54) ULTRAVIOLET NIGHTLIGHT METHOD AND APPARATUS FOR SCORPION ILLUMINATION AND DETECTION

(76) Inventor: Walter Edwin Balfour, Chandler, AZ (US)

( * ) Notice: Subject to any disclaimer, the term of this patent is extended or adjusted under 35 U.S.C. 154(b) by 0 days.

(21) Appl. No.: 13/252,371

(22) Filed: Oct. 4, 2011

(65) Prior Publication Data

US 2012/0099306 A1 Apr. 26, 2012

Related U.S. Application Data

(60) Provisional application No. 61/406,025, filed on Oct. 22, 2010.

(51) Int. Cl.

| | |
|---|---|
| ***H01R 33/00*** | (2006.01) |
| ***F21K 2/00*** | (2006.01) |
| ***F21V 23/04*** | (2006.01) |
| ***F21S 8/00*** | (2006.01) |

(52) U.S. Cl.

CPC ..... *F21S 8/035* (2013.01); *F21V 23/0442* (2013.01)

USPC ..... 362/231; 362/641; 362/642

(58) Field of Classification Search

USPC ..... 362/231, 641–644

See application file for complete search history.

(56) References Cited

U.S. PATENT DOCUMENTS

| | | | | |
|---|---|---|---|---|
| 4,806,770 | A | 2/1989 | Hylton | |
| 5,685,637 | A * | 11/1997 | Chapman et al. | 362/263 |
| 5,806,961 | A | 9/1998 | Dalton | |
| 6,174,078 | B1 * | 1/2001 | Ohm et al. | 362/477 |
| 6,280,051 | B1 | 8/2001 | Wallach | |
| 6,474,851 | B1 * | 11/2002 | Baley | 362/477 |
| 6,648,496 | B1 | 11/2003 | Elghoroury | |
| 6,733,150 | B1 * | 5/2004 | Hanley | 362/106 |
| 6,824,296 | B2 | 11/2004 | Souza | |
| 7,192,160 | B2 * | 3/2007 | Reiff et al. | 362/231 |
| 7,246,920 | B1 * | 7/2007 | Hopkins | 362/287 |
| 7,329,035 | B2 | 2/2008 | Feliciano | |
| 7,425,718 | B1 * | 9/2008 | Baley et al. | 362/800 |
| 8,277,098 | B2 * | 10/2012 | Ortwein et al. | 362/477 |
| 2003/0067768 | A1 * | 4/2003 | Shiau et al. | 362/184 |
| 2003/0085366 | A1 * | 5/2003 | Shanley et al. | 250/492.22 |

FOREIGN PATENT DOCUMENTS

JP 10319887 A * 12/1998

* cited by examiner

*Primary Examiner* — Mariceli Santiago

(74) *Attorney, Agent, or Firm* — Kevin Hazen

(57) ABSTRACT

The invention comprises an ultraviolet nightlight configured for illuminating walkways and/or for highlighting scorpions. In one embodiment, a nightlight is configured with an ultraviolet source. Photons emitted or radiated by the nightlight interact with a scorpion causing the scorpions to fluoresce. The fluorescing scorpion is readily observed by a human at night, thereby alerting the human and providing a measure of security and/or safety. The nightlight is optionally configured in the ultra violet and visible light range, with the visible component comprised predominantly of blue light. The emitted blue light is used to light or illuminate corridors and/or obstacles with a cool comforting color.

10 Claims, 6 Drawing Sheets

ULTRAVIOLET NIGHTLIGHT METHOD AND APPARATUS FOR SCORPION ILLUMINATION AND DETECTION

CROSS-REFERENCES TO RELATED APPLICATIONS

This application:

claims benefit of U.S. Provisional Patent Application No. 61/406,025, filed Oct. 22, 2010, all of which is incorporated herein in its entirety by this reference thereto.

TECHNICAL FIELD OF THE INVENTION

The present invention relates to the field of nightlights.

BACKGROUND OF THE INVENTION

A nightlight or night light is a small light source, often electrical, placed for comfort or convenience in indoor dark areas or areas that become dark at certain times. An example of a nightlight is a dim light kept burning at night, such as in a child's bedroom. Additionally, people use nightlights for a sense of security and/or for a nyctophobia (fear of the dark) solution. Still further, nightlights are useful for revealing a general layout of a room without turning on a major light so as to avoiding tripping over stairs, to mark obstacles, and/or to mark an emergency exit.

Nightlights

Several reports of nightlights have been reported.

Nightlights

M. Feliciano, et. al., "Child's Nightlight", U.S. Pat. No. 7,329,035 (Feb. 12, 2008) describes a nightlight that can be held or worn by a child and that can project three-dimensional images to provide assurance to the child.

M. Souza, et. al., "Night Light Assembly", U.S. Pat. No. 6,824,296 (Nov. 30, 2004) describes a nightlight assembly that plugs directly into a wall receptacle where the nightlight has a base assembly affixed to the wall and a rotatable cover member configured with a low wattage lamp and lens.

H. Elghoroury, et. al., "Nightlight with Light Emitting Diode Source", U.S. Pat. No. 6,648,496 (Nov. 18, 2003) describes a nightlight configured with a series of light-emitting diodes mounted within a housing.

Flashlight/Nightlight Combination

W. Wallach, "Combination Flashlight and Night Light", U.S. Pat. No. 6,280,051 (Aug. 28, 2001) describes a combination flashlight and nightlight. A traditional flashlight without a backreflector is described with a cap for the flashlight. When the cap is in place, light exits only through the rear half of the flashlight through a liquid, which acts as a nightlight for kids.

D. Dalton, et. al., "Rechargeable Flashlight Assembly with Nightlight", U.S. Pat. No. 5,806,961 (Sep. 15, 1998) describes a flashlight with a first light source functioning as a flashlight and a second light source functioning as a nightlight where the two sources share power and a mount and are separately selected with a rotating element.

Ultraviolet Lights

D. Baley, et. al., "Lighting System, Point Source Lights Therefor and Methods of Making the Same", U.S. Pat. No. 7,425,718 (Sep. 16, 2008) describe a lighting system comprising a lighting assembly configured with at least one ultraviolet light source mounted upon a portion of the side of a boat.

W. Hylton, et. al., "Germicidal Toothbrush Holder", U.S. Pat. No. 4,806,770 (Feb. 21, 1989) describe a germicidal toothbrush holder configured with a ultraviolet lamp emitting radiation in the 200 to 300 nanometer wavelength range and radiation in the visible range. The ultraviolet lamp is on continuously to expose the toothbrush to germicidal radiation. A portion of the holder is translucent to visible light so that the toothbrush holder additional functions as a nightlight for the bathroom.

Scorpions

Scorpions are predatory arthropod animals of the order scorpions within the class arachnida. Scorpions have eight legs and are readily recognized by a pair of grasping claws and a narrow segmented tail, which is carried in a characteristic forward curve over the back terminating with a venomous stinger.

Scorpions glow or luminesce when exposed to certain wavelengths of ultraviolet light due to the presence of fluorescent chemicals, such as beta-carboline, in the cuticle. Fluorescence occurs as a result of sclerotization and increases in intensity with successive instars.

Problem

What is needed is a nightlight configured to dimly light a corridor or passageway to aid human movement at night and/or to highlight scorpions for safety.

SUMMARY OF THE INVENTION

The invention comprises an ultraviolet nightlight configured for illuminating walkways and/or for highlighting scorpions.

BRIEF DESCRIPTION OF THE DRAWINGS

A more complete understanding of the present invention is derived by referring to the detailed description and claims when considered in connection with the Figures, wherein like reference numbers refer to similar items throughout the Figures.

Elements and steps in the figures are illustrated for simplicity and clarity and have not necessarily been rendered according to any particular sequence. For example, steps that are performed concurrently or in different order are illustrated in the figures to help improve understanding of embodiments of the present invention.

DETAILED DESCRIPTION OF THE PREFERRED EMBODIMENTS

The invention comprises an ultraviolet nightlight configured for illuminating walkways and/or for highlighting scorpions.

In one embodiment, a nightlight is configured with an ultraviolet source. Photons emitted or radiated by the nightlight interact with a scorpion causing the scorpions to fluoresce, luminesce, glow, and/or shine. The fluorescing scorpion is readily observed by a human at night, or in a darkened area, thereby alerting the human and providing a measure of security and/or safety.

In another embodiment, the nightlight is configured in the ultra violet and visible light range, with the visible component comprised predominantly of blue light. The emitted blue light is used to light or illuminate corridors and/or obstacles with a cool comforting color.

DEFINITIONS

Herein, the nightlight provides, emits, radiates, and/or projects light, such as in illumination of an object. Herein, colloquial uses for terms of light broadcast by the nightlight are used, so that the; terms emits, radiates, and projects are used interchangeably.

Herein, terminology for light originating for the scorpion is also used colloquially. Hence, the light originating or emitting from the scorpion is referred to as fluorescence, luminescence, and/or phosphorescence.

Ultraviolet Nightlight

Figure 1:
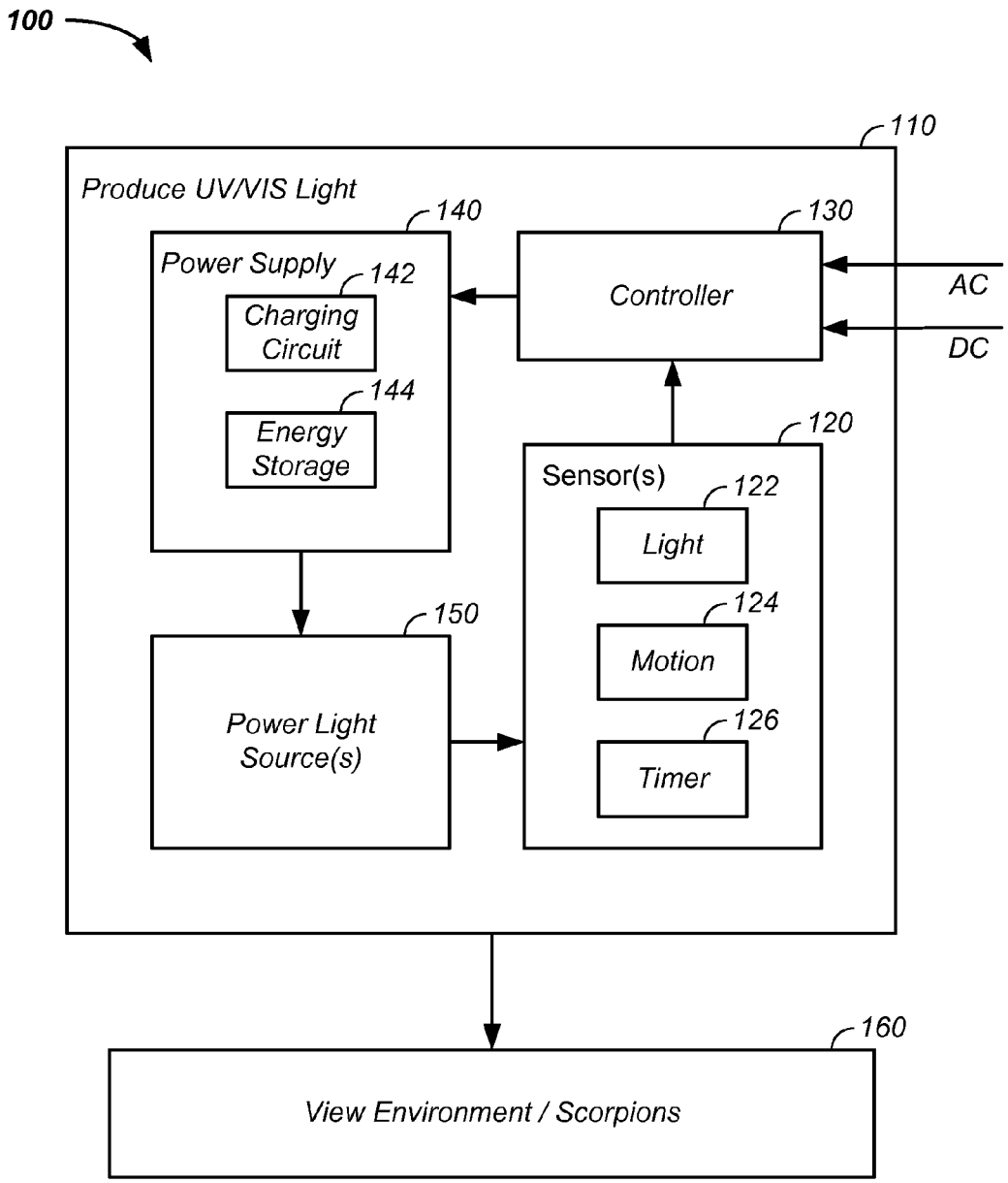
FIG. 1 is a block diagram of a method of use of a scorpion nightlight.

Referring now to FIG. 1, a block diagram of a method of use of a nightlight 100 is provided. Generally, a nightlight 110 provides ultraviolet and/or visible light to illuminate:

- a passageway;
- a corridor;
- an obstacle; and/or
- a scorpion.

The nightlight 110 optionally includes: a sensor 120, a controller 130, a power supply 140, and/or a light source 150. More particularly, the sensor 120 includes any of: a light intensity sensor 122, a motion sensor 124, and/or a timer 126 any of which are used to automatically turn on/off the nightlight 110. The light intensity sensor 122 is optionally an ambient light sensor and/or is a source intensity light sensor used in a feedback loop to control the intensity of the source. The sensor 120 provides a sensor reading to the controller 130, which is electrically connected to the power supply 140. Optionally, the power supply includes a charging circuit 142 charging an energy storage device 144 or is a unit directing an auxiliary alternating current (AC) or direct current (DC) power supply. The power supply 140 drives one or more light sources 150, described infra. The nightlight 110 is configured to provide light, which in used to view a local environment 160, such as a corridor and/or a scorpion.

Electrical Outlet Mounted Nightlight

Figure 2:
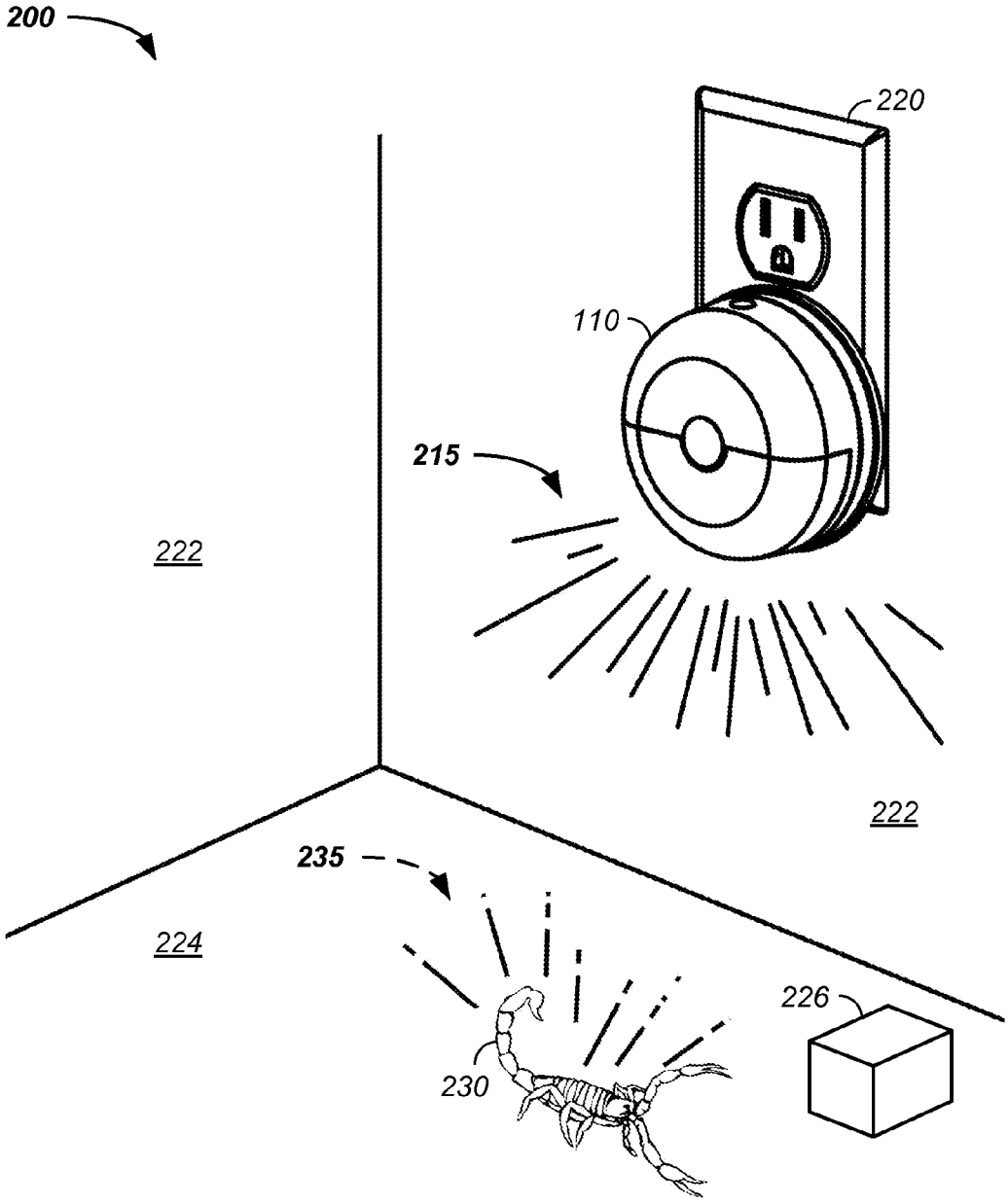
FIG. 2 is a perspective view of an outlet configured nightlight interacting with a scorpion.

Referring now to FIG. 2, an electrical outlet mounted example 200 of the nightlight 110 configured for use with an electrical wall outlet 220 is provided. In this example, the nightlight 110 is provided alternating current power from the outlet 220, which is used for permanent installation or is used for recharging the internal energy source 144, such as a battery. The battery is used as a backup power supply for times when the alternating current is interrupted and/or is used as the main power supply when the nightlight is removed from the wall outlet 220, described infra. In this example, the nightlight 110 emits light 215 that strikes a wall 222, a floor 224, an obstacle or an environmental element 226, and/or a scorpion 230. Light fluorescing 235 from the scorpion 230 is visible to the human eye. The fluorescent light 235 warns the human of the presence of the scorpion 230, thereby providing a continual feeling of security and an acute warning of danger.

Figure 3:
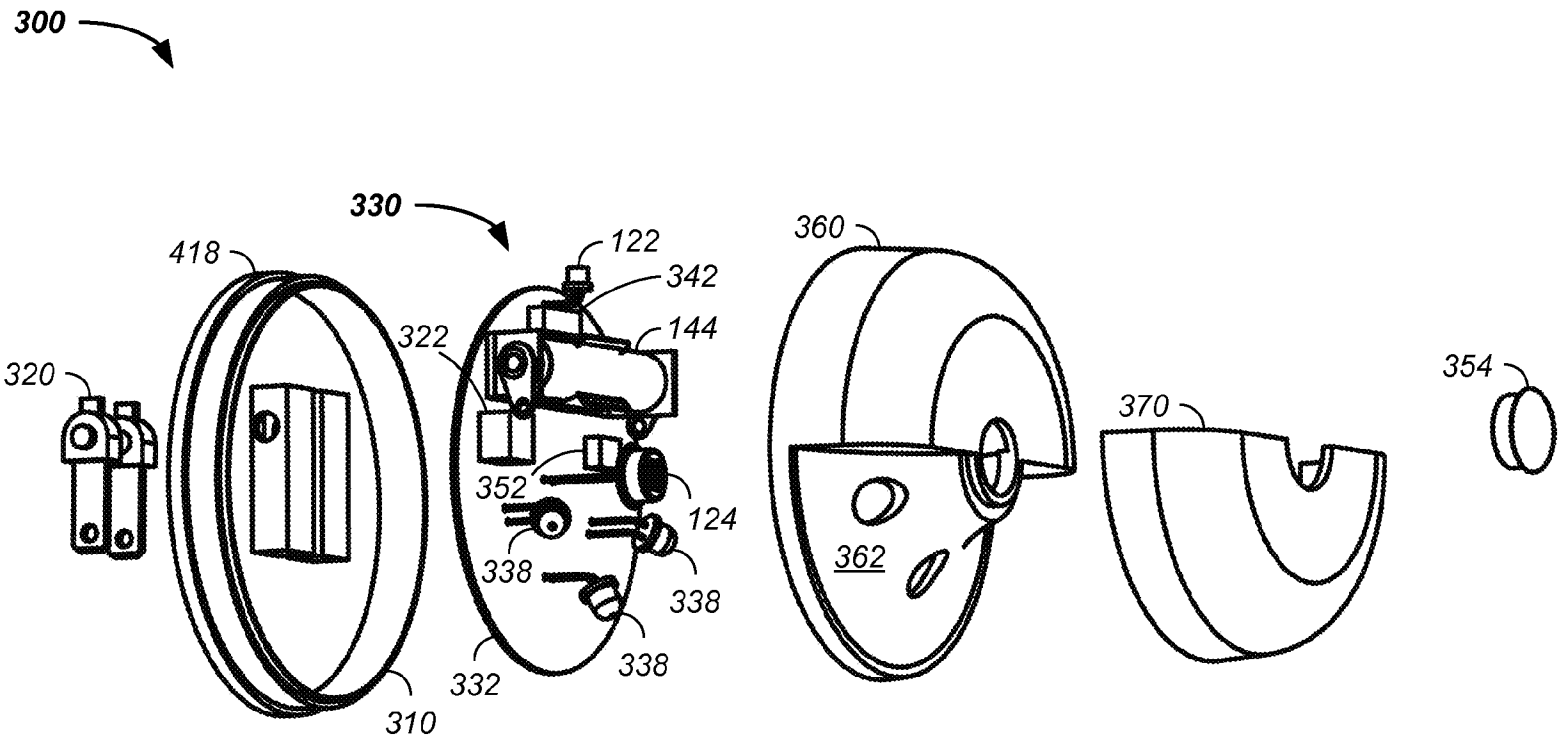
FIG. 3 is a partially exploded view of the nightlight.

Referring now to FIG. 3, an exploded view 300 of a particular example of the nightlight 110 is provided. In this example, the nightlight 110 includes:

- a case back 310;
- a circuit board 330;
- a main body 360; and/or
- a light diffuser 370, such as a light diffusing lens.

Each of the nightlight 110 elements is further described herein. The case back 310 optionally houses an electrical plug of a flip out electrical plug 320, which interfaces to the wall outlet 220. The flip out nature of the plug 320 allows mounting of the nightlight 110 to a mounting bracket, described infra. The case back 310 optionally holds and/or interfaces with an electrical circuit board 330. The circuit board 330 electrically connects one or more of:

- a charging controller 322, which controls power flow from the wall outlet 220 through the electrical plug to the energy storage device 144;
- a light sensor controller 342, which mechanically and/or electrically interfaces with the light sensor 122;
- a motion sensor controller 352, which mechanically and/or electrically interfaces with the motion sensor 124 that optionally has a cover 354; and/or
- one or more light-emitting diodes 338.

The case back 310 interfaces with the main body 360, such as to enclose the circuit board 330. The main body 360 optionally contains a lower reflective portion 362 configured to reflect light from the light-emitting diodes 338. The lower reflective portion 362 of the main body 360 is optionally covered with a light cover 370. The light cover is optionally: transparent, translucent, and/or is configured with one or more light diffusing elements, described infra. The example of the nightlight 110 illustrated in FIG. 3 is a species of a scorpion nightlight. Generally, the nightlight 110 includes any mechanical and/or electrical configuration of elements providing at least ultraviolet light to the surrounding environment.

Wall Mounted Nightlight

Figure 4:
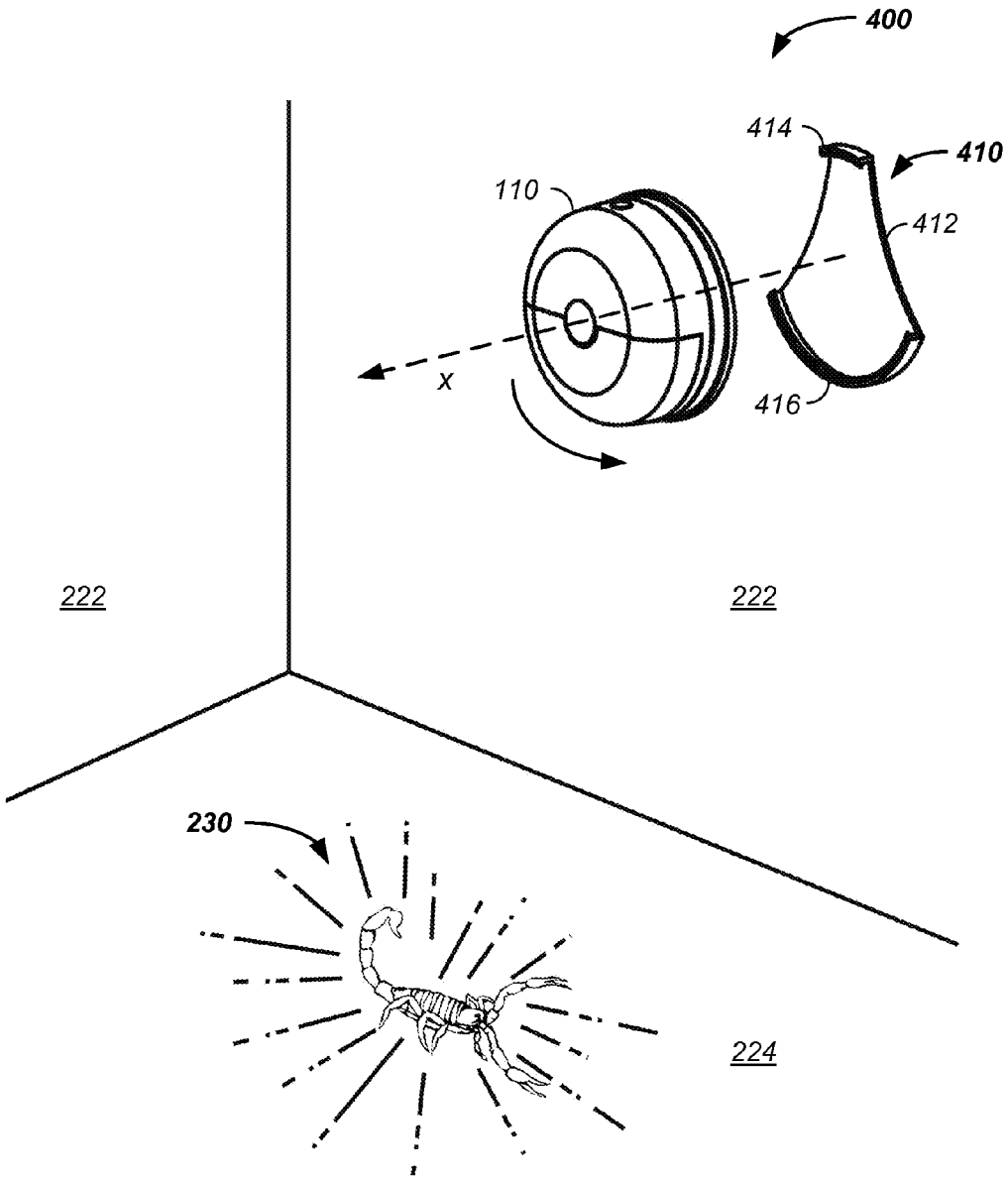
FIG. 4 is a perspective view of a wall mounted nightlight illuminating a scorpion.

Referring now to FIG. 4, a wall mounted example 400 of the nightlight 110 is illustrated. In a first case, the wall mounted nightlight 400 is a battery powered nightlight. In a second case, the wall mounted nightlight is the electrical outlet mounted outlet 200 with the flip out plug 320 configured in a folded orientation to allow flush mounting of the case back 310 with a mounting surface, such as the wall 222. In either case, the nightlight 110 is optionally mounted to a mounting bracket 410. The mounting bracket 410 is affixed to a support surface, such as the wall 222, such as with an adhesive strip affixed to the back of the case back 310 or via screws running through the case back 310. The mounting bracket 410 optionally contains a snap fit connector, such as along at least a portion of an outer edge of the mounting bracket 310. In the illustrated example, the snap fit connector includes an upper mounting bracket connector 414 and a lower mounting bracket connector 416 connected by a back face 412. The case back 310 optionally contains a mating connector 418 that combines with upper and lower bracket connectors 414, 416 to replaceably attach the nightlight 110 to the mounting bracket 410. The nightlight 110 is rotatable about an axis. For example, as illustrated the nightlight 110 is rotatable about an x-axis that runs perpendicular to a mounting surface, such as the wall 222.

Figure 5:
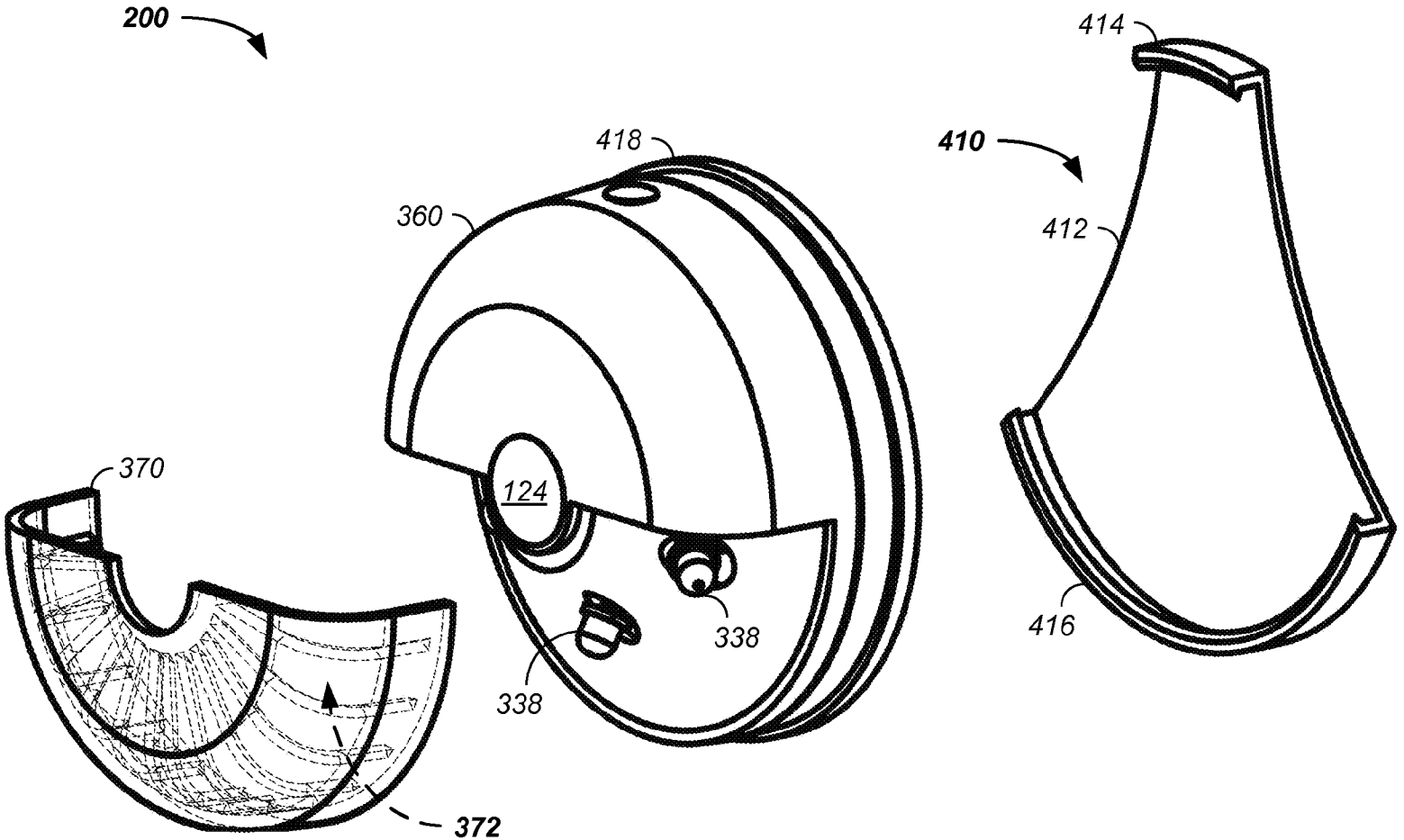
FIG. 5 illustrates a rotationally moveable diffuser on a nightlight.

Referring now to FIG. 5, an example of a nightlight 110 having a light cover 370 is provided in an exploded view format. The light cover 370 is illustrated with a diffuser element 372. A diffuser element spreads the light emitted by the diodes 338. As illustrated, the diffuser element 372 is a set of slits cut through the light cover 370. Optionally, the diffuser element is a rough inner and/or outer surface of the light cover, is a partially mirrored surface, and/or is a set of holes or apertures through the light cover. As described, supra, the case back 310, main body 360, and light cover 370 are optionally rotatable relative to the mounting bracket 410. Hence, the light cover is aimed or directed as a function of rotation of the nightlight 110.

Still referring to FIG. 5, the light-emitting diodes 338 are optionally set at angles relative to one another. For example, individual light-emitting diodes of a set of light-emitting diodes are optionally aimed, such as to any angle or clock position. As illustrated, the three light-emitting diodes are aimed at about the 4 o'clock, 6 o'clock, and 8 o'clock positions, though they are optionally aimed at any clock position. In addition, the individual light-emitting diodes are optionally rotated away from the plane defined by the mounting surface, such as about 10, 20, 30, 40, 50, or 60 degrees.

Light

The nightlight 110 optionally uses an incandescent bulb and/or a light-emitting diode 338 or a semiconductor light source.

Figure 6:
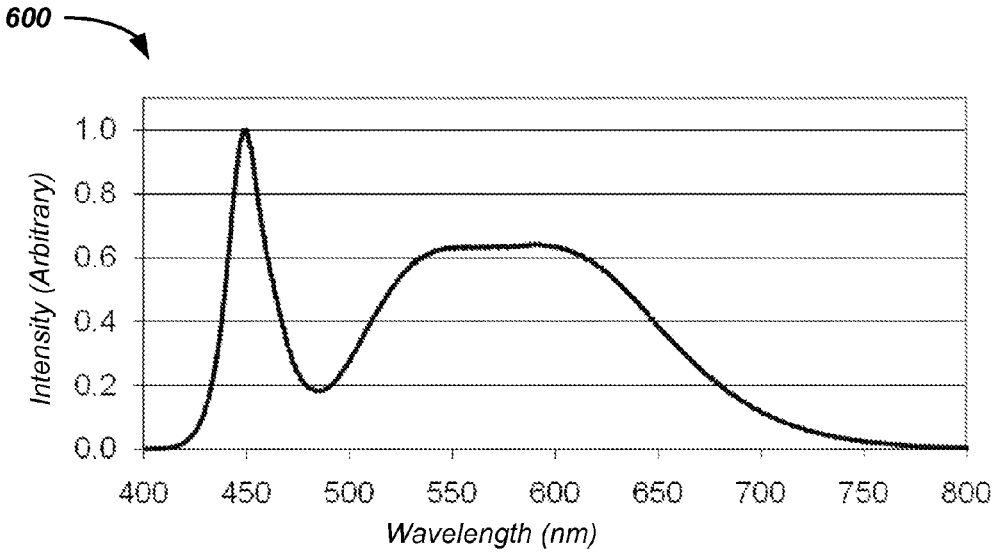
FIG. 6 illustrates a spectrum of a traditional incandescent light source.

Referring now to FIG. 6, a spectrum of a typical incandescent bulb is illustrated. The incandescent spectrum is characterized by:

a peak intensity at a wavelength greater than 440 nm;

an intensity weighted average wavelength of about 550 nm; and/or intensities of greater than twenty percent of maximum intensity at wavelengths greater than 500 nm.

Figure 7:
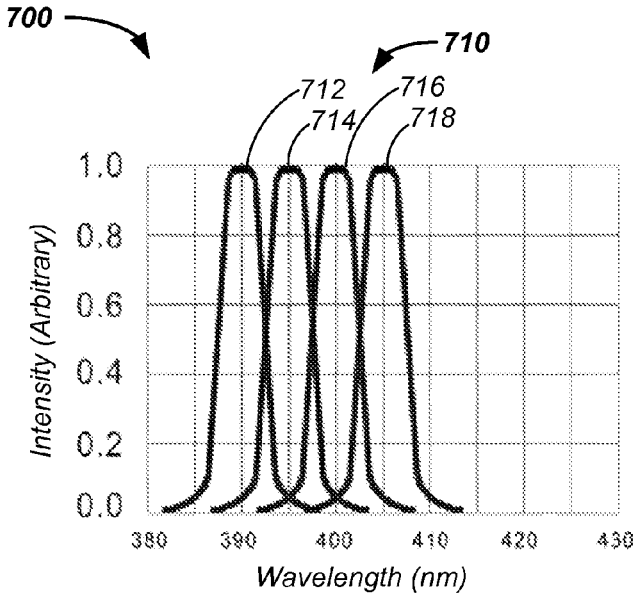
FIG. 7 illustrates spectra of a mixed array of light-emitting diodes.

Preferably, the nightlight 110 uses at least one ultraviolet light-emitting diode or laser diode. Examples of ultraviolet light-emitting diodes are diodes including one or more of: gallium, gallium nitride, gallium and indium, aluminum gallium nitride, or aluminum gallium indium nitride. Referring now to FIG. 7, spectra of four light-emitting diodes 338 are presented with peak intensities at about 390 nm 712, 395 nm 714, 400 nm 716, and 405 nm 718. Generally, an ultraviolet equipped nightlight includes:

at least one local intensity maximum at a wavelength greater than about 350 nm and less than any of
about 410 nm;
about 400 nm; and/or
about 390 nm;

an average intensity weighted wavelength of less than any of 500, 450, or 400 nm;

two or more local maxima at greater than about 300, 325, 350, or 375 nm and less than about 410 nm;

two, three, four, or more light-emitting diodes;

at least two light-emitting diodes with individual peak spectral intensities greater than about five nanometers apart;

less than ten percent of the integrated light intensity at wavelengths longer than about 420 nm; and/or a full-width at half height spectrum of an individual light-emitting diode of less than about twenty nanometers.

Optionally, the nightlight contains 1, 2, 3, 4, 5 or more light-emitting diodes 338. Optionally, 2, 3, 4, or more light-emitting diodes of a set of light-emitting diodes in the nightlight 110 have peak spectral intensities separated by at least four nanometers. For instance, the nightlight 110 equipped with three light-emitting diodes optionally has light-emitting diodes emitting with a peak intensity at about:

about 390 nm, 390 nm, and 390 nm;
about 395 nm, 395 nm, and 395 nm;
about 400 nm, 400 nm, and 400 nm;
about 405 nm, 405 nm, and 390 nm;
about 390 nm, 395 nm, and 400 nm; and
about 390 nm, 395 nm, and 395 nm.

Generally:

2, 3, 4, or more light-emitting diodes emit with peak intensities at different wavelengths, such as about 4 or more nm apart;

2, 3, 4, or more light-emitting diodes emit with peak intensities at about the same wavelength, such as within about 3 nm; and/or at least one ultraviolet light-emitting diode and at least one visible light-emitting diode.

In one case, at least one light-emitting diode emits at wavelengths longer than about 400 nm and less than about 425, 450, 475, or 500 nm to allow the human eye to perceive the light so as to provide a visual indicator of the environment, such as walls and corridors and/or to avoid obstacles. In another case, the nightlight 110 is configured with 1, 2, 3 or more light-emitting diodes and at least one incandescent source.

In yet another embodiment, the invention comprises any combination and/or permutation of the above described elements.

The particular implementations shown and described are illustrative of the invention and its best mode and are not intended to otherwise limit the scope of the present invention in any way. Indeed, for the sake of brevity, conventional manufacturing, connection, preparation, and other functional aspects of the system are not described in detail. Furthermore, the connecting lines shown in the various figures are intended to represent exemplary functional relationships and/or physical couplings between the various elements. Many alternative or additional functional relationships or physical connections are typically present in a complete system but are not integral to the invention described.

In the foregoing description, the invention has been described with reference to specific exemplary embodiments; however, various modifications and changes may be made without departing from the scope of the present invention as set forth. The description and figures are to be regarded in an illustrative manner, rather than a restrictive one and all such modifications are intended to be included within the scope of the present invention. Accordingly, the scope of the invention should be determined by the generic embodiments described and their legal equivalents rather than by merely the specific examples described above. For example, the steps recited in any method or process embodiment are optionally executed in any order and are not limited to the explicit order presented in the specific examples. Additionally, the components and/or elements recited in any apparatus embodiment are optionally assembled or otherwise operationally configured in a variety of permutations to produce substantially the same result as the present invention and are accordingly not limited to the specific configuration recited in the specific examples.

Benefits, other advantages, and solutions to problems have been described above with regard to particular embodiments; however, any benefit, advantage, solution to problems, or any element that causes any particular benefit, advantage or solution to occur or to become more pronounced are not to be construed as critical, required, or essential features or components.

The terms "comprises", "comprising", "include", "including", or any variation thereof, are intended to reference a non-exclusive inclusion, such that a process, method, article, composition, or apparatus that includes a list of elements does not include only those elements recited, but also includes other elements not expressly listed or inherent to such process, system, method, article, composition, or apparatus. Other combinations and/or modifications of the above-described structures, arrangements, applications, proportions, elements, materials, or components used in the practice of the present invention, in addition to those not specifically recited, are readily varied or otherwise particularly adapted to specific environments, manufacturing specifications, design parameters, or other operating requirements without departing from the general principles of the same.

Although the invention has been described herein with reference to certain preferred embodiments, one skilled in the art will readily appreciate that other applications may be substituted for those set forth herein without departing from the spirit and scope of the present invention. Accordingly, the invention should only be limited by the Claims included below.

The invention claimed is:

1. An apparatus configured for providing light, comprising:
a nightlight, comprising:
a housing comprising a front side and a back side;
an alternating current outlet plug affixed to said back side of said housing;
a case back affixed to said back side of said housing;
a light diffuser affixed to said front side of said housing; and
a source at least partially enclosed in said housing, said source configured to during use:
emit a first amount of light from about 350 to about 400 nanometers; and
emit a second amount of light from about 400 to about 700 nm,
wherein said first amount of light exceeds said second amount of light,
wherein said source comprises a set of light-emitting diodes, said set comprising at least two light-emitting diodes, and
wherein a first light-emitting diode of said set of light-emitting diodes is configured to provide a first peak spectral intensity at a wavelength less than 400 nm, wherein a second light-emitting diode of said set of light-emitting diodes is configured to provide a second peak spectral intensity at a wavelength greater than 400 nm.

2. The apparatus of claim 1, said alternating current outlet plug comprising:
a flip out plug, said flip out plug foldable from a charging position to a deployment position, said flip out plug in said charging position configured for insertion into an alternating current outlet.

3. The apparatus of claim 2, further comprising:
a mounting bracket configured for mounting on a mounting surface, said nightlight configured to replaceably mount in said mounting bracket when said plug is configured in said deployment position.

4. The apparatus of claim 3, further comprising:
a first snap on element affixed to said mounting bracket; and
a second snap on element affixed to said case back, said second snap on element configured to hold said nightlight to said mounting bracket through a connection with said first snap on element.

5. The apparatus of claim 4, wherein said nightlight comprises rotational freedom of motion relative to said mounting bracket.

6. The apparatus of claim 1, wherein said set of light emitting diodes comprises at least three light emitting diodes, wherein peak intensities of at least two of said three light emitting diodes differs by at least seven nanometers, said at least two of said three light emitting diodes configured to emit light in the range of 350 to 400 nm.

7. The apparatus of claim 1, further comprising:
a circuit board electrically mounted in said nightlight, said circuit board connected to each of:
at least one light-emitting diode of said set of light-emitting diodes;
a motion sensor; and
a light sensor.

8. The apparatus of claim 7, further comprising:
a motion sensor cover configured for replaceable attachment over said motion sensor.

9. The apparatus of claim 7, wherein said light diffuser comprises a set of cuts therethrough.

10. An apparatus configured for providing light, comprising:
a nightlight, comprising:
a housing comprising a front side and a back side;
an alternating current outlet plug affixed to said back side of said housing;
a case back affixed to said back side of said housing;
a light diffuser affixed to said front side of said housing; and
a source at least partially enclosed in said housing, said source configured to during use:
emit a first amount of light from about 350 to about 400 nanometers; and
emit a second amount of light from about 400 to about 700 nm,
wherein said first amount of light exceeds said second amount of light,
wherein said source comprises a set of light-emitting diodes, said set comprising at least two light-emitting diodes,
wherein a first light-emitting diode of said set of light emitting diodes is configured to provide a first peak intensity at a first wavelength less than 400 nm, wherein a second light-emitting diode of said set of light emitting diodes is configured to provide a second peak intensity at a second wavelength less than 400 nm, wherein said first wavelength differs from said second wavelength by at least five nanometers.

* * * * *